US006280283B1

(12) United States Patent
Sisler

(10) Patent No.: US 6,280,283 B1
(45) Date of Patent: Aug. 28, 2001

(54) DOLL KIT

(76) Inventor: Constance R. Sisler, 50 Sutton Pl., South, New York, NY (US) 10022

( * ) Notice: Subject to any disclaimer, the term of this patent is extended or adjusted under 35 U.S.C. 154(b) by 0 days.

(21) Appl. No.: 09/247,616

(22) Filed: Feb. 10, 1999

(51) Int. Cl.[7] ..... A63H 3/16

(52) U.S. Cl. ..... 446/100; 446/118; 446/369; 446/391

(58) Field of Search ..... 446/97, 98, 99, 446/100, 118, 321, 369, 391

(56) References Cited

U.S. PATENT DOCUMENTS

| | | | | |
|---|---|---|---|---|
| 2,331,776 | * | 10/1943 | Heggedal | 446/98 |
| 3,210,884 | * | 10/1965 | Sharff et al. | 446/100 |
| 4,122,628 | * | 10/1978 | Crowell et al. | 446/100 |
| 4,979,924 | * | 12/1990 | Manger | 446/100 |
| 5,195,917 | * | 3/1993 | Russell et al. | 446/97 |
| 5,348,510 | * | 9/1994 | DuPont et al. | 446/100 |
| 5,746,639 | * | 5/1998 | Bloom et al. | 446/98 |
| 6,015,358 | * | 1/2000 | Spector | 446/100 X |

FOREIGN PATENT DOCUMENTS

| | | | | |
|---|---|---|---|---|
| 2559676 | * | 8/1985 | (FR) | 448/100 |

* cited by examiner

*Primary Examiner*—John A. Ricci
(74) *Attorney, Agent, or Firm*—Frommer Lawrence & Haug LLP; William S. Frommer

(57) ABSTRACT

A doll kit comprises a body having a torso and a head, body covered with material that releasably holds hook fastening material. Facial features, body features, clothes and accessories having mounting surfaces covered, at least in part, with hook fastening material, that releasable holds the fastening material and are operable to be attached to the body. A display member formed of material that releasably holds hook fastening material receives the facial features, body features clothes and accessories for storing and displaying the facial features, complete faces, body features, clothes and accessories when they are not attached to the body. The body includes either two arms and two legs or four legs (or fantasy-like appendages), is three-dimensional and is stuffed with a soft stuffing material. The doll kit may resemble a humanoid or an animal figure, insect figure, fantasy creature, prehistoric creature or the like.

38 Claims, 6 Drawing Sheets

20
54
50
52
66
60
64
58
62
66
76
72
60
62
60
39
74
35
34
24
32
32
28
28
71
68
80
71
70
82
90
86
88
84

DOLL KIT

BACKGROUND OF THE INVENTION

This invention relates to a doll kit and, more particularly, to a doll kit for creating or modifying a doll having a humanoid or animal appearance.

Toy kits for constructing dolls and other figures have long been available in two-dimensional versions, wherein children cut figures from cardboard and apply paper clothes over them. Another toy kit in the prior art has a body molded out of hard plastic with a fanciful shape. The body has holes and facial and body features having pegs attached to them are placed in the holes to attach the facial and body features to the plastic body. The facial and body features are also molded out of hard plastic, so that when the body is decorated with such facial and body features, the result is a hard plastic toy. It has been a historical problem to keep, store and display the facial and body features where they are readily available, can be seen and selected and not lost.

Stuffed humanoid and animal dolls have long proven to be popular. These known stuffed dolls have a shortcoming that their appearance cannot be changed. As a consequence, considerable effort must be expended to change the facial and body features, clothes and accessories. Thus, a male doll with blond hair remains a male doll with blond hair and cannot be changed to resemble its owner or someone that the owner of the doll is trying to emulate.

OBJECTS OF THE INVENTION

Therefore, it would be beneficial to provide an improved doll kit, which overcomes the drawbacks of the prior art.

Accordingly, it is an object of the invention to provide a versatile, soft, three-dimensional doll wherein accessories including facial and body features, clothing, body parts and accessories may be readily placed upon and removed from the doll.

A further object of the invention is to provide a doll kit to handle, store and display parts of the kit including facial and body features, clothing and accessories as desired.

Still other objects and advantages of the invention will in part be obvious and will in part be apparent from the specification and drawings.

SUMMARY OF THE INVENTION

In order to attain the above objects, according to an aspect of the present invention, a doll kit is provided. The doll kit comprises a body having a torso and head. The body is covered with a material for releasably holding hook fastening material. Facial features, body features, clothes and accessories have mounting surfaces covered, at least in part, with hook fastening material and operable to be releasably attached to the body are also provided. A display member covered with or formed of material for releasably holding hook fastening material is operable to receive the facial features, body features, clothes and accessories for storing and displaying the facial features, body features, clothes and accessories when they are not attached to the body. The body includes either two arms and two legs or four legs. The doll kit is three-dimensional and is stuffed with a soft stuffing material. The doll kit may resemble a humanoid or an animal figure.

The above and other objects, features and advantages of the present invention will become apparent from the following description and the appended claims, taken in conjunction with the accompanying drawings in which like parts or elements are denoted by like reference characters.

BRIEF DESCRIPTION OF THE DRAWINGS

For a more complete understanding of the invention, reference is made to the following description and accompanying drawings, in which.

DESCRIPTION OF THE PREFERRED EMBODIMENTS

Figure 1:
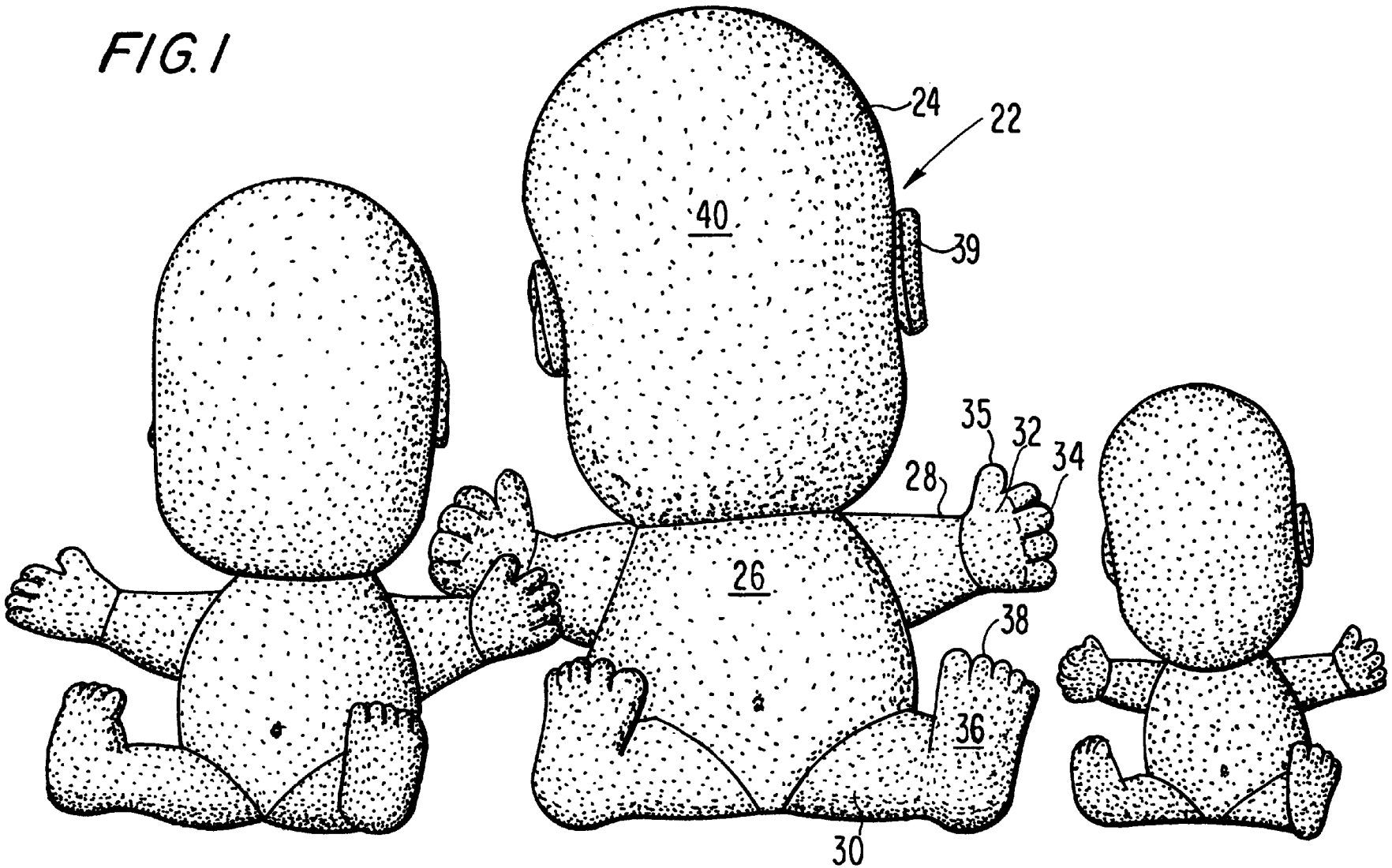
FIG. 1 is a diagram of examples of a humanoid body in accordance with the first embodiment of the present invention.

Referring first to FIG. 1, examples of a stuffed, three-dimensional body 22 are shown in accordance with a first embodiment of the present invention. The three examples are proportionally similar but differ in size. The body 22 includes a head 24, a torso 26, two arms 28 and two legs 30. Each arm 28 has one end attached to the torso 26 and another end attached to a hand 32 having fingers 34 and a thumb 35. One end of each leg 30 is attached to the torso 26 and another end attached to a foot 36, having toes 38.

Attached to the head 24 is a set of ears 39 (which may be removable). The portions of the body 22 are arranged in a humanoid or human-like form.

The body 22 is covered with a cover member 40 comprising, in one embodiment, a looped fabric which may be made of any suitable material such as woven textile material having loops extending therefrom that are stitched together. This may be referred to as the looped portion of a hook-and-loop "Velcro" type fastener to which hook fastening material is releasably held. In the preferred embodiment, the cover member 40 may be made of any textile material that releasably holds hook fastening material, and is not necessarily made of loop material. The cover member 40 is extended over a stuffing material, (not shown) which may be of any suitable cushion-like material such as plastic foam.

Figure 2:
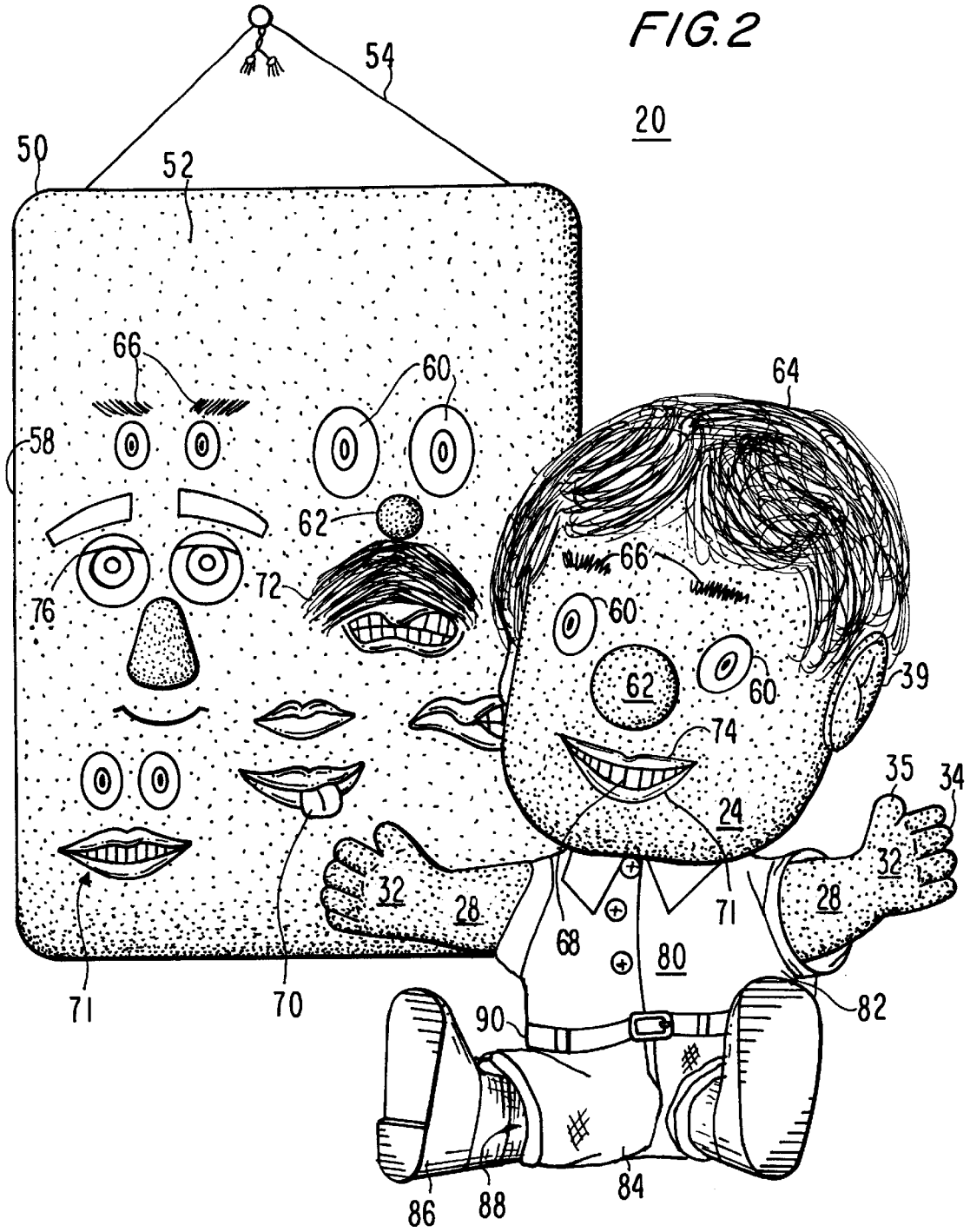
FIG. 2 is a diagram illustrating one of the humanoid bodies of FIG. 1, together with facial features, clothing and display member.
Figure 2A:
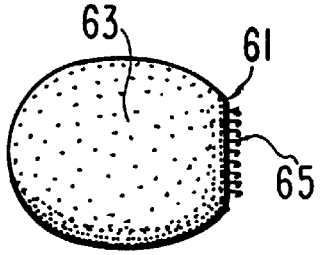

Referring now to FIG. 2, a doll kit 20 is shown in accordance with a first embodiment of the present invention. The doll kit 20 includes changeable accessories whose back portion is provided with a mounting surface, such as mounting surface 61 on the back portion of nose 63 (shown in FIG. 2A) covered, at least in part with hook fastening material 65 such that the accessories are receivable upon the cover member 40 of the body 22. The accessories are removable and positionable upon the three-dimensional body 22 by placement of the hook fastening material on the mounting surface of the accessories onto selected locations of the body. The changeable accessories comprise facial and body features including eyes 60, nose 62, hair 64, eye brows 66, teeth 68, tongues 70, moustache 72, lips 74 and mouths 71. Such facial and body features may be in the form of flannel outer cover members that are backed at least in part by hook fastening material as part of a "Velcro" type fastener. The facial and body features may be made of any material, soft or rigid, provided the back portion thereof is provided with the aforementioned mounting surface covered, at least in part, with hook fastening material.

Also provided are clothes 80 that may be attached to the body 22, such as shirts 82, pants (or shorts or skirts) 84, shoes 86, socks 88 and belt 90. These are merely illustrative. The clothes 80 may be any clothes wearable by humans or animals. The clothes 80 may also have the aforementioned mounting surfaces on their back portions to releasably hold the clothes 80 to the body 22.

Figure 3:
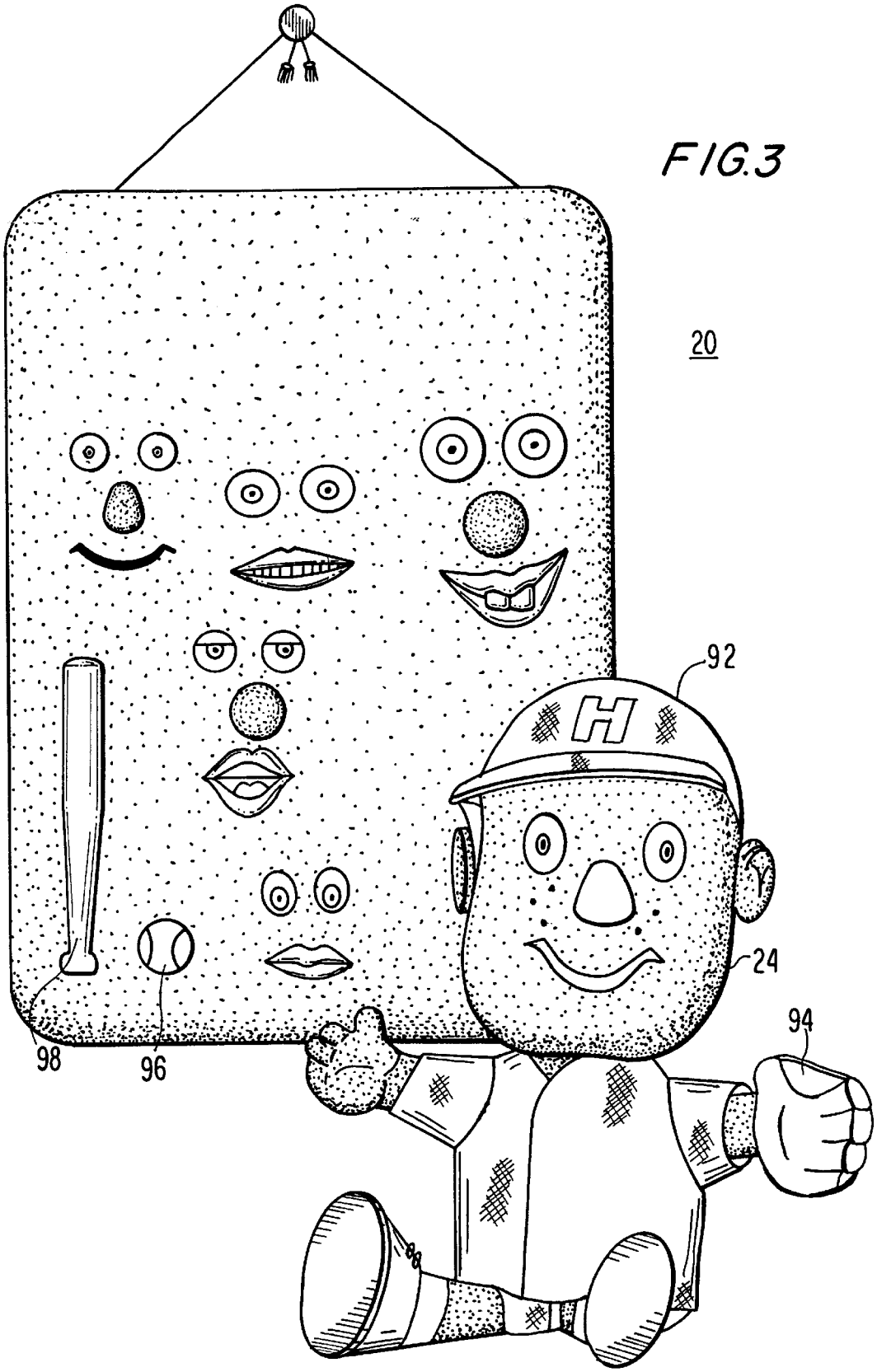
FIG. 3 is a diagram illustrating the humanoid body of FIG. 1, together with other facial features, clothing, accessories and display member.

Additional accessories are shown in FIG. 3, including a hat 92 sized to fit onto the head 24 of body 22. The hat 92 may be any type of headgear or head attire and may have the aforementioned mounting surfaces to releasably attach the hat to the head. A glove 94 is sized to fit over the hand 32 of body 22. Other accessories may be a ball 96, a bat 98 and any other items identified with a sport, profession, etc.

A display member 50 is also provided as part of doll kit 20. The display member 50 is formed of a member 52 comprising material similar to the cover member 40 of the body 22 and preferably may be made of any textile material that releasably holds hook fastening material. In one embodiment, cover member 52 may be covered, at least in part, with the looped portion of a "Velcro" type fastener. The member 52 preferably is cloth material that can be rolled, folded or otherwise manipulated. Alternatively, the cover member 52 extends over a rigid material, (not shown) which may be of any suitable rigid material such as wood or cardboard. The facial and body features 58, clothes 80 and accessories will therefore be operable to releasably attach to cover member 52 of the display member 50 for storing and displaying the facial and body features 58, clothes 80 and accessories when they are not attached to the body 22. The display member 50 may have a hanging rope or thread 54 or a support means (not shown) so that the display member 50 may be hung on a wall, door or other supporting structure at a raised elevation, or supported in an upright position. Displaying the facial and body features 58, clothes 80 and accessories allows a user to compare and select the facial and body features, clothes and accessories that satisfy the requirements of the user.

Facial features, clothes and accessories selected and releasably attached to the doll may be adjusted, added, moved or removed to provide a variety of expressions, ages, professions and features thus varying the appearance of the doll according to the desires of the user. The doll kit may be used to work with children in psychological, educational, law enforcement or artistic settings to construct a doll that resembles real or hypothetical persons and enables the child to exercise artistic and creative expression.

Figure 4:
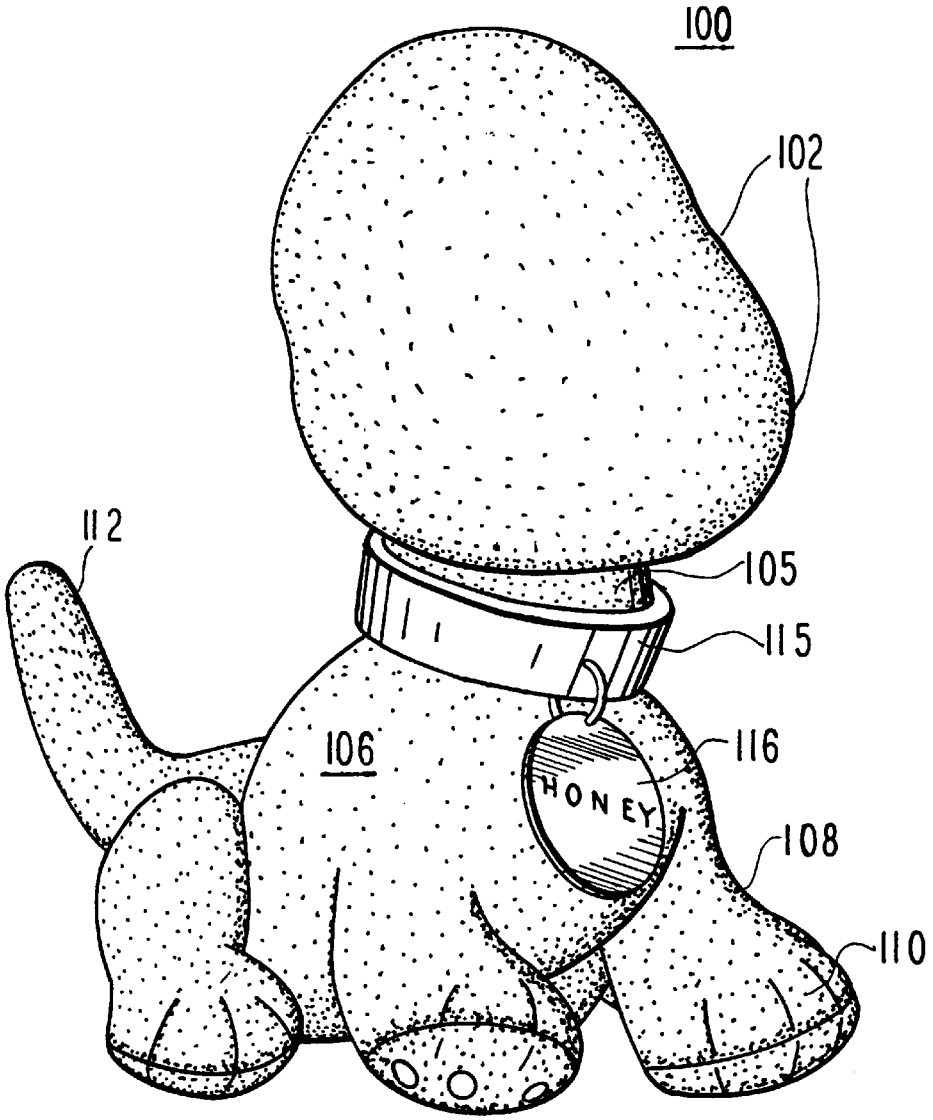
FIG. 4 is a diagram illustrating an example of an animal body in accordance with a second embodiment of the present invention.

Referring to FIG. 4, a stuffed, three-dimensional body 102 is constructed in accordance with a second embodiment of the present invention. The body 102 includes a head 104, a neck 105, a torso 106, and four legs 108. One end of each leg 108 is attached to the torso 106 and the other end is attached to a paw 110. Also attached to the torso 106 is a tail 112 (which may be a removable body feature). A collar 115 with a medallion 116 may surround the neck 105. The portions of the body 102 are arranged in an animal-like form. Other forms contemplated herein are insect, fantasy, monster, prehistoric, extinct, futuristic, or the like.

The body 102 is covered with a cover member 118 similar to aforedescribed cover member 40 and, thus may be made of any suitable material such as woven textile material that releasably holds hook fastening material. In one embodiment, this material has loops extending therefrom, such as the looped portion of a "Velcro" type fastener. The cover member 118 is extended over a stuffing material, (not shown) which may be of any suitable cushion-like material such as plastic foam.

Figure 5:
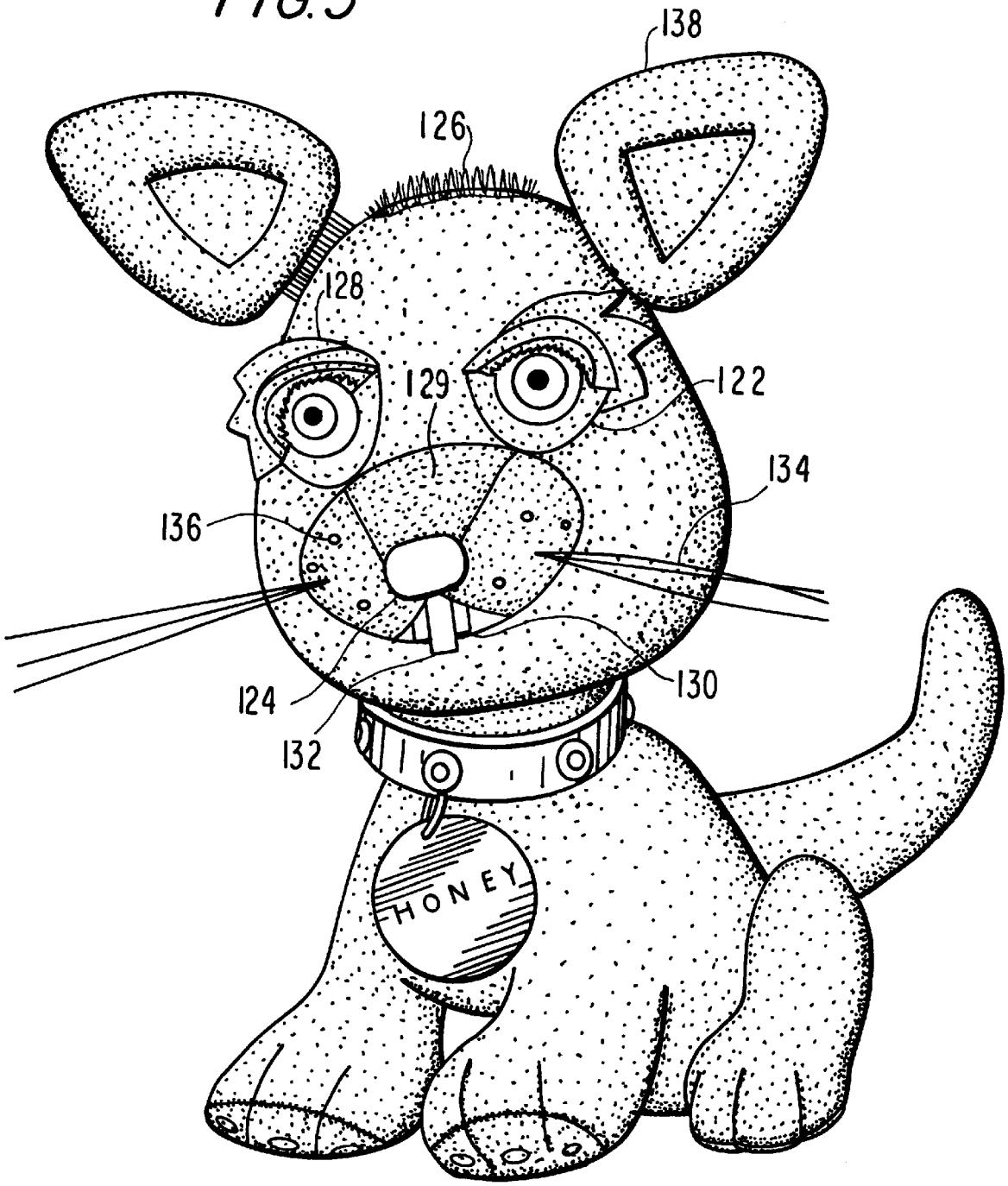
FIG. 5 is a diagram illustrating the animal body of FIG. 4, together with facial features and body features.

Referring now to FIG. 5, a doll kit 100 is shown in accordance with a second embodiment of the present invention. The doll kit 100 includes changeable accessories whose back portions are provided with mounting surfaces covered, at least in part, with hook fastening material that is releasably attached to cover member 118 of the body 102. The accessories are temporarily stored on a display member, similar to display member 50, from which they are removable and positionable upon the three-dimensional body 102 by placement of the hook fastening material upon selectable portions of body 102. The changeable accessories comprise facial and body features including eyes 122, nose 124, hair 126, eye brows 128, snout 129, teeth 130, tongues 132, whiskers 134, freckles 136 and ears 138. Other animal, insect, monster prehistoric and fantasy creature features may be included. Such facial and body features may be in the form of flannel outer cover members similar to what was described in conjunction with FIGS. 2 and 3, whose back portions are provided with the aforementioned mounting surface covered, at least in part, with hook fastening material, which is the hook part of a "Velcro" type fastener. The facial and body features may be made of any material, soft or rigid.

Figure 6:
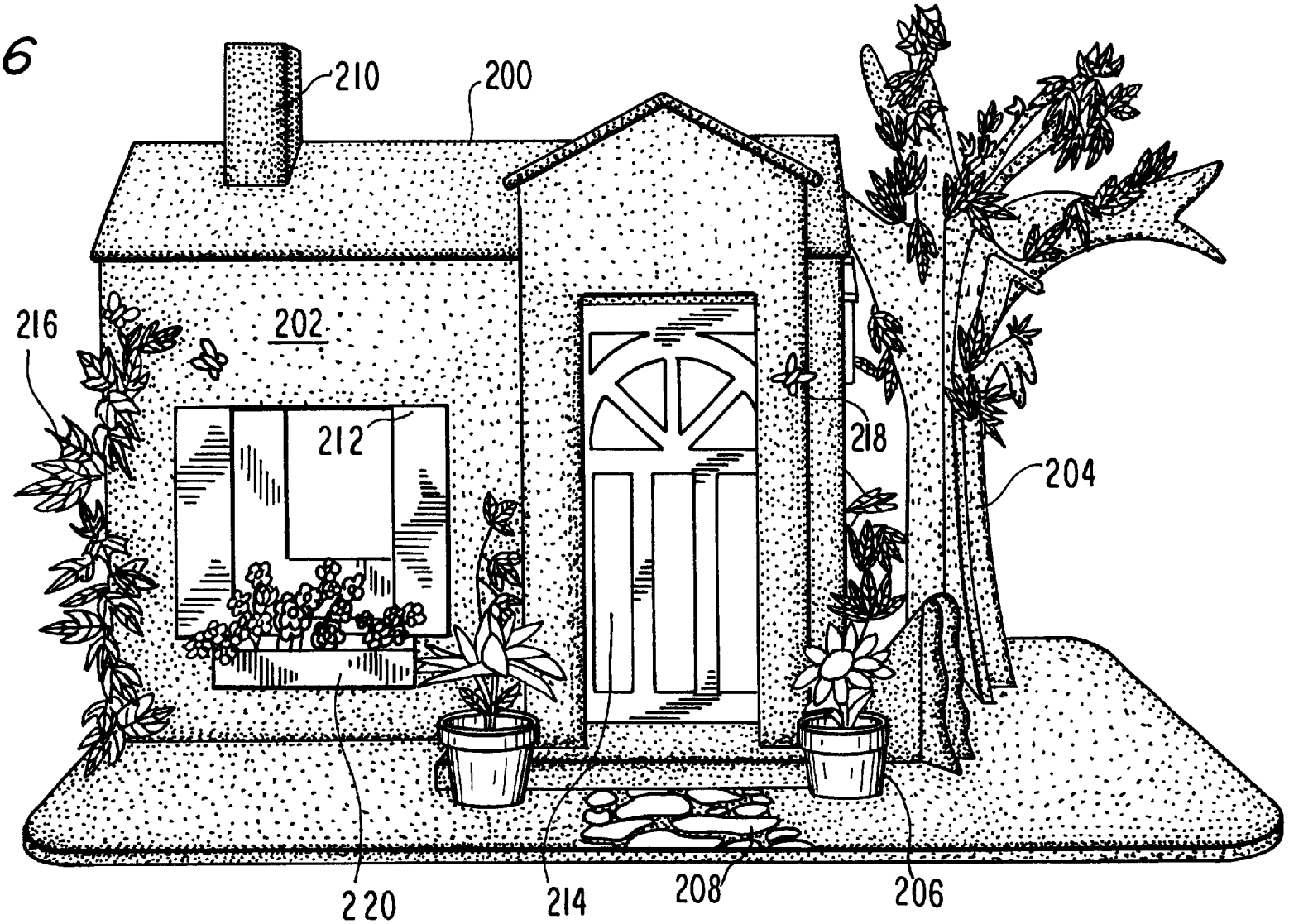
FIG. 6 is a diagram illustrating a doll house in accordance with a third embodiment of the present invention.

Referring now to FIG. 6, a doll house 200 is shown. The doll house 200 includes structural members 202 which are rigid and are covered with a cover member comprising, in one embodiment, a looped fabric which may be made of any suitable material such as woven textile material having loops extending therefrom that are stitched together. This may be referred to as the looped portion of a hook-and-loop "Velcro" type fastener to which hook fastening material is releasably held. In the preferred embodiment, the cover member may be made of any textile material that releasably holds hook fastening material, and is not necessarily made of loop material. The cover member is extended over a rigid structural material, (not shown) which may be of any suitable material such as cardboard.

The doll house 200 includes changeable accessories whose edge and/or back portions are provided with mounting surfaces covered, at least in part, with hook fastening material such that they may be fastened together and so that the accessories are receivable upon the cover member of the structural members 202. The accessories are removable and positionable upon the three-dimensional structure by placement of the hook fastening material on the mounting surface of the accessories onto selected locations of the structural members 202. The changeable accessories comprise trees 204, flowers 206, stepping stones 208, chimney 210, shutters 212, doors 214, plants 216, insects 218 and flower boxes 220. Other structural and accessories features may be included. Such accessories may be in the form of flannel outer cover members similar to what was described in conjunction with FIGS. 2 and 3, whose back portions are provided with the aforementioned mounting surface covered, at least in part, with hook fastening material, which is the hook part of a "Velcro" type fastener. The structural members 202 of doll house 200 fold flat when taken apart.

Having now fully described the invention, it will be apparent to one of ordinary skill in the art that many changes and modifications can be made thereto without departing from the spirit and scope of the invention as set forth herein.

What is claimed is:

1. A doll kit, comprising:

a body having a torso and a head, said body covered with a material for releasably holding book fastening material;

facial features having a mounting surface covered, at least in part, with said hook fastening material operable to be attached to said body; and a display member formed of a flexible, rollable cloth material for releasably holding said hook fastening material and operable to receive said facial features for storing and, when said cloth material is unrolled, displaying said facial features when said facial features are not attached to said body, said cloth having a rope secured thereto for suspending said display member at a raised elevation.

2. The doll kit of claim 1 wherein said body includes two arms and two legs.

3. The doll kit of claim 2 and further comprising hands attached to said arms.

4. The doll kit of claim 3 and further comprising fingers attached to said hands.

5. The doll kit of claim 3 and further comprising gloves that are operable to be attached to said hands.

6. The doll kit of claim 2 and further comprising feet attached to said legs.

7. The doll kit of claim 6 and further comprising toes attached to said feet.

8. The doll kit of claim 2 wherein said facial features are humanoid.

9. The doll kit of claim 1 wherein said body includes four legs.

10. The doll kit of claim 9 and further comprising paws attached to said legs.

11. The doll kit of claim 9 wherein said facial features resemble those of animals.

12. The doll kit of claim 9 and further including body features, each having a mounting surface covered, at least in part, with said hook fastening material and operable to be releasably attached to said body and to said display member.

13. The doll kit of claim 12 wherein said body features include different types of tails.

14. The doll kit of claim 12 wherein said body features include different types of ears.

15. The doll kit of claim 1 wherein said body is three-dimensional.

16. The doll kit of claim 4 wherein said body is stuffed with a soft stuffing material.

17. The doll kit of claim 1 wherein said facial features include different types of noses.

18. The doll kit of claim 1 wherein said facial features include different types of hair.

19. The doll kit of claim 1 wherein said facial features include different types of eyes.

20. The doll kit of claim 1 wherein said facial features include different types of eye brows.

21. The doll kit of claim 1 wherein said facial features include different types of moustaches.

22. The doll kit of claim 1 wherein said facial features include different types of mouths.

23. The doll kit of claim 1 wherein said facial features include different types of teeth.

24. The doll kit of claim 1 wherein said facial features include different types of tongues.

25. The doll kit of claim 1 wherein said facial features include different types of whiskers.

26. The doll kit of claim 1 wherein said facial features include different types of beards.

27. The doll kit of claim 1 wherein said facial features include different types of facial markings.

28. The doll kit of claim 1 wherein said facial features include different types of facial hair.

29. The doll kit of claim 1 and further comprising clothes having mounting surfaces covered, at least in part, with said hook fastening material and operable to be releasably attached to said body and to said display member.

30. The doll kit of claim 29 wherein said clothes include different types of shirts.

31. The doll kit of claim 29 wherein said clothes include different types of pants.

32. The doll kit of claim 29 wherein said clothes include different types of coats.

33. The doll kit of claim 29 wherein said clothes include different types of ties.

34. The doll kit of claim 29 wherein said clothes include different types of dresses.

35. The doll kit of claim 29 wherein said clothes include different types of skirts.

36. The doll kit of claim 1 and further comprising accessories having mounting surfaces covered, at least in part, with said hook fastening material and operable to be releasably attached to said body and to said display member.

37. The doll kit of claim 1 and further comprising a hanging means attached to said display member for suspending said display member from an elevated location.

38. The doll kit of claim 1 and further comprising a support means attached to said display member for supporting said display member in an upright position.

* * * * *